US009441452B2

(12) United States Patent
Donald et al.

(10) Patent No.: US 9,441,452 B2
(45) Date of Patent: Sep. 13, 2016

(54) OILFIELD APPARATUS AND METHODS OF USE

(71) Applicants: Ian Donald, Monymusk (GB); John Reid, Inchture (GB)

(72) Inventors: Ian Donald, Monymusk (GB); John Reid, Inchture (GB)

( * ) Notice: Subject to any disclaimer, the term of this patent is extended or adjusted under 35 U.S.C. 154(b) by 0 days.

(21) Appl. No.: 14/396,658

(22) PCT Filed: Apr. 26, 2013

(86) PCT No.: PCT/GB2013/051058

§ 371 (c)(1),
(2) Date: Oct. 23, 2014

(87) PCT Pub. No.: WO2013/160686

PCT Pub. Date: Oct. 31, 2013

(65) Prior Publication Data

US 2015/0114658 A1 Apr. 30, 2015

Related U.S. Application Data

(60) Provisional application No. 61/639,018, filed on Apr. 26, 2012.

(51) Int. Cl.
*E21B 33/076* (2006.01)
*E21B 34/04* (2006.01)
(Continued)

(52) U.S. Cl.
CPC ..... *E21B 34/04* (2013.01); *E21B 33/035* (2013.01); *E21B 33/076* (2013.01); *E21B 43/01* (2013.01); *E21B 43/16* (2013.01); *E21B 2034/007* (2013.01)

(58) Field of Classification Search
CPC .... E21B 33/068; E21B 33/076; E21B 34/04; E21B 43/01; E21B 43/16; E21B 2034/007
USPC ..... 166/344, 351, 368, 373, 53, 325; 137/497
See application file for complete search history.

(56) References Cited

U.S. PATENT DOCUMENTS 3,973,587 A * 8/1976 Cochran ..... 137/496
4,047,695 A * 9/1977 Cleveland et al. ..... 251/122
(Continued)

FOREIGN PATENT DOCUMENTS

GB 2377425 A 1/2003
WO 00/70185 A1 11/2000
(Continued)

OTHER PUBLICATIONS

International Search Report dated Apr. 7, 2014 from International Patent Application No. PCT/2013/051058 filed Apr. 26, 2013.
(Continued)

*Primary Examiner* — Matthew R Buck
(74) *Attorney, Agent, or Firm* — Sunstone IP

(57) ABSTRACT

The invention provides a flow control valve for a subsea hydrocarbon production system and a method of use. The flow control valve comprises an inlet configured to be in fluid communication to an injection fluid conduit and an outlet configured to be in fluid communication with a subsea flow system. A flow control mechanism is disposed in a flow path between the inlet and the outlet and is arranged to adjust a flow rate through the flow path. The flow control mechanism is configured to automatically adjust the flow rate of injection fluid through the flow path according to a pressure differential between fluid pressure at the inlet and fluid pressure at the outlet. Adjustment may be self-regulating, or may be controlled by a hydraulic control circuit.

20 Claims, 8 Drawing Sheets

(51) Int. Cl.

| | |
|---|---|
| ***E21B 33/035*** | (2006.01) |
| ***E21B 43/01*** | (2006.01) |
| ***E21B 43/16*** | (2006.01) |
| *E21B 34/00* | (2006.01) |

(56) References Cited

U.S. PATENT DOCUMENTS

| | | | | |
|---|---|---|---|---|
| 4,540,022 | A * | 9/1985 | Cove | 137/625.3 |
| 4,748,011 | A * | 5/1988 | Baize | 423/228 |
| 6,460,620 | B1 * | 10/2002 | LaFleur | 166/324 |
| 6,481,504 | B1 * | 11/2002 | Gatherar | 166/344 |
| 6,536,528 | B1 * | 3/2003 | Amin et al. | 166/369 |
| 6,776,188 | B1 * | 8/2004 | Rajewski | 137/624.13 |
| 6,973,936 | B2 * | 12/2005 | Watson | E21B 33/068 137/1 |
| 7,040,408 | B2 | 5/2006 | Sundararajan et al. | |
| 7,219,740 | B2 | 5/2007 | Saucier | |
| 7,757,772 | B2 | 7/2010 | Donohue et al. | |
| 8,181,705 | B2 * | 5/2012 | Tveiten et al. | 166/344 |
| 8,186,440 | B2 * | 5/2012 | Tveiten et al. | 166/344 |
| 2003/0056955 | A1 * | 3/2003 | Watson | 166/305.1 |
| 2010/0059221 | A1 | 3/2010 | Vannuffelen et al. | |
| 2011/0061854 | A1 | 3/2011 | Davies | |
| 2012/0111571 | A1 | 5/2012 | Eriksen | |

FOREIGN PATENT DOCUMENTS

| | | | |
|---|---|---|---|
| WO | 2005/047646 | A1 | 5/2005 |
| WO | 2005/083228 | A1 | 9/2005 |
| WO | 2007/016678 | A2 | 2/2007 |
| WO | 2012/107727 | A2 | 8/2012 |
| WO | 2013/121212 | A2 | 8/2013 |

OTHER PUBLICATIONS

International Preliminary Report on Patentability dated Oct. 28, 2014 from International Patent Application No. PCT/2013/051058 filed Apr. 26, 2013.

Ian Donald et al: "Using MARS (Multiple Application Re-Injection Sysem) Technology for Improving Oil Recovery and Reducing Production Risk," Proceedings of International Oil and Gas Conference and Exhibition in China, Jun. 8, 2010, XP055063295, DOI: 10.2118/132274-MS, ISBN: 978-1-55-563295-3.

Office Action dated Mar. 21, 2016 from U.S. Appl. No. 14/396,660, filed Oct. 23, 2014.

Office Action dated Feb. 3, 2016 from U.S. Appl. No. 14/396,660, filed Oct. 23, 2014.

Office Action dated Sep. 3, 2015 from U.S. Appl. No. 14/396,660, filed Oct. 23, 2014.

Office Action dated Feb. 29, 2016 from U.S. Appl. No. 14/379,277, filed Aug. 15, 2014.

Office Action dated Aug. 6, 2015 from U.S. Appl. No. 14/379,277, filed Aug. 15, 2014.

* cited by examiner

OILFIELD APPARATUS AND METHODS OF USE

The present invention relates to oilfield apparatus and methods of use, and in particular a flow control valve and method for fluid intervention in oil and gas production or injection systems. A preferred embodiment of the invention is a valve with multiple flow control functions. The invention has particular application to subsea oil and gas operations, and aspects of the invention relate specifically to methods and apparatus for fluid injection, and to combined fluid injection and sampling applications.

BACKGROUND TO THE INVENTION

In the field of oil and gas exploration and production, it is common to install an assembly of valves, spools and fittings on a wellhead for the control of fluid flow into or out of the well. Such flow systems typically include a Christmas tree, which is a type of fluid manifold used in the oil and gas industry in surface well and subsea well configurations. A Christmas tree has a wide range of functions, including chemical injection, well intervention, pressure relief and well monitoring. Christmas trees are also used to control the injection of water or other fluids into a wellbore to control production from the reservoir.

There are a number of reasons why it is desirable to access a flow system in an oil and gas production system (generally referred to as an "intervention"). In the context of this specification, the term "fluid intervention" is used to encapsulate any method which accesses a flow line, manifold or tubing in an oil and gas production, injection or transportation system. This includes (but is not limited to) accessing a flow system for fluid sampling, fluid diversion, fluid recovery, fluid injection, fluid circulation, fluid measurement and/or fluid metering. This can be distinguished from full well intervention operations, which generally provide full (or near full) access to the wellbore. Full well intervention processes and applications are often technically complex, time-consuming and have a different cost profile to fluid intervention operations. It will be apparent from the following description that the present invention has application to full well intervention operations. However, it is an advantage of the invention that full well intervention may be avoided, and therefore preferred embodiments of the invention provide methods and apparatus for fluid intervention which do not require full well intervention processes.

International patent application numbers WO00/70185, WO2005/047646 and WO2005/083228 describe a number of configurations for accessing a hydrocarbon well via a choke body on a Christmas tree. Although a choke body provides a convenient access point in some applications, the methods of WO00/70185, WO2005/047646, and WO2005/083228 do have a number of disadvantages. Firstly, a Christmas tree is a complex and carefully-designed piece of equipment. The choke performs an important function in production or injection processes, and its location on the Christmas tree is selected to be optimal for its intended operation. Where the choke is removed from the choke body, as proposed in the prior art, the choke must be repositioned elsewhere in the flow system to maintain its functionality. This compromises the original design of the Christmas tree, as it requires the choke to be located in a sub-optimal position.

Secondly, a choke body on a Christmas tree is typically not designed to support dynamic and/or static loads imparted by intervention equipment and processes. Typical loads on a choke body in normal use would be of the order of 0.5 to 1 tonnes, and the Christmas tree is engineered with this in mind. In comparison, a typical flow metering system as contemplated in the prior art may have a weight of the order of 2 to 3 tonnes, and the dynamic loads may be more than three times that value. Mounting a metering system (or other fluid intervention equipment) on the choke body therefore exposes that part of the Christmas tree to loads in excess of those that it is designed to withstand, creating a risk of damage to the structure. This problem may be exacerbated in deepwater applications, where even greater loads may be experienced due to thicker and/or stiffer components used in the subsea infrastructure.

In addition to the load restrictions identified above, positioning the flow intervention equipment on the choke body may limit the access available to large items of process equipment and/or access of divers or remotely operated vehicles (ROVs) to the process equipment or other parts of the tree.

Furthermore, modifying the Christmas tree so that the chokes are in non-standard positions is generally undesirable. It is preferable for divers and/or ROV operators to be completely familiar with the configuration of components on the Christmas tree, and deviations in the location of critical components are preferably avoided.

Another drawback of the prior art proposals is that not all Christmas trees have chokes integrated with the system; approaches which rely on Christmas tree choke body access to the flow system are not applicable to these types of tree.

It is amongst the objects of the invention to provide a method and apparatus for accessing a flow system in an oil and gas production system, which addresses one or more drawbacks or disadvantages of the prior art. In particular, it is amongst the objects of the invention to provide a method and apparatus for fluid intervention in an oil and gas production system, which addresses one or more drawbacks of the prior art. An object of the invention is to provide a flexible method and apparatus suitable for use with and/or retrofitting to industry standard or proprietary oil and gas production manifolds, including Christmas trees.

It is an aim of at least one aspect or embodiment of the invention to provide an apparatus which may be configured for use in both a subsea fluid injection operation and a production fluid sampling operation and a method of use.

An aim of at least one aspect of the invention is to provide a flow control valve which is improved with respect to flow control valves of the prior art. A further aim of at least one aspect of the invention is to provide a flow control valve which facilitates the use of novel flow system access methods and fluid intervention operations.

Further objects and aims of the invention will become apparent from the following description.

SUMMARY OF THE INVENTION

According to a first aspect of the invention there is provided a flow control valve for a subsea hydrocarbon production system, the flow control valve comprising:

an inlet configured to be in fluid communication to an injection fluid conduit;

an outlet configured to be in fluid communication with a subsea flow system;

a flow control mechanism disposed in a flow path between the inlet and the outlet and arranged to adjust a flow rate through the flow path;

wherein the flow control mechanism is configured to automatically adjust the flow rate of injection fluid through the flow path according to a pressure differential between fluid pressure at the inlet and fluid pressure at the outlet.

The flow control mechanism may be configured to close to prevent fluid flow in the flow path in a direction from the outlet to the inlet in response to a pressure differential between fluid pressure in the injection fluid conduit and fluid pressure in the subsea flow system.

Alternatively or in addition, the flow control mechanism may be configured to close in response to a low pressure condition at the injection fluid conduit.

The valve may be a pressure balanced valve, and/or the flow control mechanism may be operable by a hydraulic control circuit.

Alternatively or in addition, the flow control mechanism may be configured to be actuated to close to prevent fluid flow through the flow path, either by a control signal or by a failsafe close actuation mechanism.

The valve may comprise a spool assembly, which may be movable in a valve bore, and which may controlled by a torque bucket stem. The spool position may define a valve orifice. The spool assembly preferably comprises a sleeve, which may comprise plurality of radial ports.

The valve may comprise a choke sleeve assembly, which may be movable in a valve bore, and which may controlled by a torque bucket stem. The choke position may define a valve orifice. The choke sleeve assembly preferably comprises a choke sleeve, which may comprise plurality of radial ports.

The valve may comprise a check poppet, which may be axially movable with respect to the choke sleeve. The check poppet may function as a back flow prevention valve.

The valve may comprise a spool piece, which may located internally to the choke sleeve. The position of the spool piece with respect to the choke sleeve may be controlled by a pressure drop across the valve orifice. The spool piece is preferably movable in the valve to regulate a flow rate through the valve by opening and closing radial ports.

The valve of this embodiment may be described as a self-regulating valve.

The valve may comprise an ambient pressure vent, which functions to close the valve if the pressure at the inlet drops to a pressure below ambient pressure.

According to a second aspect of the invention there is provided a subsea fluid injection system for a subsea hydrocarbon production system, the subsea fluid injection system comprising:

an injection fluid conduit;

a subsea flow system;

and a flow control valve disposed between the injection fluid conduit and the subsea flow system;

wherein the flow control valve comprises a flow control mechanism disposed in a flow path between the injection fluid conduit and the subsea flow system and arranged to adjust a flow rate of injection fluid passing through the flow path;

and wherein the flow control mechanism is configured to automatically adjust the flow rate of injection fluid through the flow path according to a pressure differential between fluid pressure in the injection fluid conduit and fluid pressure in the subsea flow system.

Embodiments of the second aspect of the invention may include one or more features of the first aspect of the invention or its embodiments, or vice versa.

According to a third aspect of the invention there is provided a method of performing a subsea fluid injection operation in a subsea hydrocarbon production system, the method comprising:

providing an injection fluid conduit coupled to a subsea flow system;

providing a flow control valve between the injection fluid conduit and the subsea flow system;

injecting an injection fluid from the injection fluid conduit to the subsea flow system through a flow path of the flow control valve;

adjusting the flow rate of injection fluid through the flow path automatically using a flow control mechanism responsive to a pressure differential between fluid pressure in the injection fluid conduit and fluid pressure in the subsea flow system.

Embodiments of the third aspect of the invention may include one or more features of the first or second aspects of the invention or their embodiments, or vice versa.

According to a fourth aspect of the invention there is provided a flow control valve for a subsea hydrocarbon production system, the flow control valve comprising:

an inlet configured to be in fluid communication to an injection fluid conduit;

an outlet configured to be in fluid communication with a subsea flow system;

a flow control mechanism disposed in a flow path between the inlet and the outlet and arranged to adjust a flow rate of injection fluid through the flow path from the inlet to the outlet;

wherein the flow control mechanism is configured to close to prevent fluid flow in the flow path in a direction from the outlet to the inlet in response to a pressure differential between fluid pressure in the injection fluid conduit and fluid pressure in the subsea flow system.

The flow control mechanism may be configured to automatically adjust the flow rate of injection fluid through the flow path according to a pressure differential between fluid pressure at the inlet and fluid pressure at the outlet.

Alternatively or in addition, the flow control mechanism may be configured to close in response to a low pressure condition at the injection fluid conduit.

Alternatively or in addition, the flow control mechanism may be configured to be actuated to close to prevent fluid flow through the flow path, either by a control signal or by a failsafe close actuation mechanism.

Embodiments of the fourth aspect of the invention may include one or more features of the first to third aspects of the invention or their embodiments, or vice versa.

According to a fifth aspect of the invention there is provided a subsea fluid injection system for a subsea hydrocarbon production system, the subsea fluid injection system comprising:

an injection fluid conduit;

a subsea flow system;

and a flow control valve disposed between the injection fluid conduit and the subsea flow system;

wherein the flow control valve comprises a flow control mechanism disposed in a flow path between the injection fluid conduit and the subsea flow system and arranged to adjust a flow rate of injection fluid passing through the flow path from the injection fluid conduit to the subsea flow system;

and wherein the flow control mechanism is configured to close to prevent fluid flow in the flow path in a direction from the subsea flow system to the injection fluid conduit in response to a pressure differential between fluid pressure in the injection fluid conduit and fluid pressure in the subsea flow system.

Embodiments of the fifth aspect of the invention may include one or more features of the first to fourth aspects of the invention or their embodiments, or vice versa.

According to a sixth aspect of the invention there is provided a method of performing a subsea fluid injection operation in a subsea hydrocarbon production system, the method comprising:

providing an injection fluid conduit coupled to a subsea flow system;

providing a flow control valve between the injection fluid conduit and the subsea flow system;

injecting an injection fluid from the injection fluid conduit to the subsea flow system through a flow path the flow control valve;

adjusting the flow rate of injection fluid through the flow path to a required injection flow rate using a flow control mechanism in the flow path;

and closing the flow control mechanism to prevent fluid flow in the flow path in a direction from the subsea flow system to the injection fluid conduit in response to a pressure differential between fluid pressure in the injection fluid conduit and fluid pressure in the subsea flow system.

Embodiments of the sixth aspect of the invention may include one or more features of the first to fifth aspects of the invention or their embodiments, or vice versa.

According to a seventh aspect of the invention there is provided a flow control valve for a subsea hydrocarbon production system, the flow control valve comprising:

an inlet configured to be in fluid communication to an injection fluid conduit;

an outlet configured to be in fluid communication with a subsea flow system;

a flow control mechanism disposed in a flow path between the inlet and the outlet and arranged to adjust a flow rate through the flow path from the inlet to the outlet;

wherein the flow control mechanism is configured to close in response to a low pressure condition at the injection fluid conduit.

The flow control mechanism may be configured to automatically adjust the flow rate of injection fluid through the flow path according to a pressure differential between fluid pressure at the inlet and fluid pressure at the outlet.

Alternatively or in addition, the flow control mechanism may be configured to close to prevent fluid flow in the flow path in a direction from the outlet to the inlet in response to a pressure differential between fluid pressure in the injection fluid conduit and fluid pressure in the subsea flow system.

Alternatively or in addition, the flow control mechanism may be configured to be actuated to close to prevent fluid flow through the flow path, either by a control signal or by a failsafe close actuation mechanism.

Embodiments of the seventh aspect of the invention may include one or more features of the first to sixth aspects of the invention or their embodiments, or vice versa.

According to an eighth aspect of the invention there is provided a subsea fluid injection system for a subsea hydrocarbon production system, the subsea fluid injection system comprising:

an injection fluid conduit;

a subsea flow system;

and a flow control valve disposed between the injection fluid conduit and the subsea flow system;

wherein the flow control valve comprises a flow control mechanism disposed in a flow path between the injection fluid conduit and the subsea flow system and arranged to adjust a flow rate of injection fluid passing through the flow path from the injection fluid conduit to the subsea flow system;

and wherein the flow control mechanism is configured to close in response to a low pressure condition at the injection fluid conduit.

Embodiments of the eighth aspect of the invention may include one or more features of the first to seventh aspects of the invention or their embodiments, or vice versa.

According to a ninth aspect of the invention there is provided a method of performing a subsea fluid injection operation in a subsea hydrocarbon production system, the method comprising:

providing an injection fluid conduit coupled to a subsea flow system;

providing a flow control valve between the injection fluid conduit and the subsea flow system;

injecting an injection fluid from the injection fluid conduit to the subsea flow system through a flow path the flow control valve;

adjusting the flow rate of injection fluid through the flow path to a required injection flow rate using a flow control mechanism in the flow path;

and closing the flow control mechanism in response to a low pressure condition at the injection fluid conduit.

Embodiments of the ninth aspect of the invention may include one or more features of the first to eighth aspects of the invention or their embodiments, or vice versa.

According to a tenth aspect of the invention there is provided a method of performing a well scale squeeze operation comprising the steps of any of the third, sixth or ninth aspects of the invention.

According to an eleventh aspect of the invention there is provided a combined fluid injection and sampling apparatus for a subsea oil and gas production flow system, the apparatus comprising:

a body defining a conduit therethrough;

a first connector for connecting the body to the flow system;

a second connector for connecting the body to a fluid injection apparatus;

wherein, in use, the conduit provides an injection path from the intervention apparatus to the flow system;

and wherein the apparatus further comprises a sampling subsystem for collecting a fluid sample from the flow system.

Preferably the sampling chamber is in fluid communication with the flow system via the first connector.

The apparatus preferably comprises a third connector for connecting the apparatus to a downstream flowline such as a jumper flowline. Therefore the apparatus may be disposed between a flowline connector and a jumper flowline, and may provide a flow path from the flow system to the jumper flowline, and may also establish an access point to the flow system, via the conduit and the first connector.

The second connector may comprise a hose connector. The apparatus may comprise a hose connection valve, which may function to shut off and/or regulate flow from a connected hose through the apparatus. The hose connection valve may comprise a choke, which may be adjusted by an ROV (for example to regulate and/or shut off injection flow).

Preferably the apparatus comprises an isolation valve between the first connector and the second connector. The isolation valve preferably has a failsafe close condition, and may comprise a ball valve or a gate valve. The apparatus may comprise a plurality of isolation valves.

The sampling subsystem may comprise an end effector, which may be configured to divert flow to a sampling chamber of the sampling subsystem of the apparatus, for example by creating a hydrodynamic pressure.

An inlet to the sampling chamber may be fluidly connected to the first connector. An outlet to the sampling chamber may provide a fluid path for circulation of fluid through the chamber and/or exit to a flowline.

Preferably, the sampling subsystem comprises a sampling port, and may further comprise one or more sampling needle valves. The sampling subsystem may be configured for use with a sampling hot stab.

The sampling subsystem may be in fluid communication with the flow system via a flow path extending between the first and third connectors. Alternatively or in addition the sampling subsystem may be in fluid communication with the flow system via a flow path extending between the first and third connectors.

Alternatively or in addition the sampling subsystem may be in fluid communication with the flow system via at least a portion of an injection bore.

Embodiments of the eleventh aspect of the invention may include one or more features of the first to tenth aspects of the invention or their embodiments, or vice versa. In particular, apparatus or systems of the first to ninth aspects of the invention may be configured with a sampling subsystem as described (to be used with in a sampling operation) and/or an injection flow path (for use in an injection operation), and the apparatus or systems of the first to ninth aspects of the invention may be configured for just one of sampling or injection.

According to a twelfth aspect of the invention there is provided a subsea oil and gas production system comprising: a subsea well; a subsea Christmas tree in communication with the well; and a combined fluid injection and sampling unit;

wherein the a combined fluid injection and sampling unit comprises a first connector connected to the flow system and a second connector for connecting the body to an intervention apparatus;

wherein, in use, the conduit provides an injection path from an injection apparatus to the flow system;

and wherein the apparatus further comprises a sampling subsystem for collecting a fluid sample from the flow system.

The system may further comprise an injection hose, which may be connected to the combined fluid injection and sampling unit. The hose may comprise an upper hose section and a subsea hose section. The upper and subsea hose sections may be joined by a weak link connector. The weak link connector may comprise a first condition, in which the connection between the upper hose and the subsea hose is locked, and a second (operable) condition, in which the upper hose is releasable from the subsea hose.

Embodiments of the twelfth eleventh aspect of the invention may include one or more features of the first to eleventh aspects of the invention or their embodiments, or vice versa.

According to a thirteenth aspect of the invention there is provided a method of performing a subsea intervention operation, the method comprising:

providing a subsea well and a subsea flow system in communication with the well;

providing a combined fluid injection and sampling apparatus on the subsea flow system, the combined fluid injection and sampling apparatus comprising a first connector for connecting the apparatus to the flow system and a second connector for connecting the apparatus to a fluid injection apparatus;

connecting an injection hose to the second connector;

accessing the subsea flow system via an injection bore between the first and second connectors.

Preferably the access hub is pre-installed on the subsea flow system and left in situ at a subsea location for later performance of a subsea intervention operation. The injection hose may then be connected to the pre-installed unit and the method performed.

Preferably the method is a method of performing a fluid intervention operation. The method may comprise fluid sampling, fluid diversion, fluid recovery, fluid injection, fluid circulation, fluid measurement and/or fluid metering.

The method may be a method of performing a well scale squeeze operation.

The method may comprise performing a well fluid sampling operation. A preferred embodiment of the invention comprises: (a) performing a fluid injection operation; and (b) performing a well fluid sampling operation. Preferably the fluid injection operation and the well fluid sampling operation are both carried out by accessing the subsea flow system via the intervention path of the access hub.

Embodiments of the thirteenth aspect of the invention may include one or more features of the first to twelfth aspects of the invention or their embodiments, or vice versa.

According to a fourteenth aspect of the invention there is provided a hose termination unit for a subsea fluid injection system, the hose termination unit comprising:

a first coupling for a subsea hydrocarbon production system;

a second coupling for a fluid injection hose;

and a flow control valve disposed between the first and second couplings;

wherein the flow control valve comprises a flow control mechanism comprising a movable spool assembly operable to move in response to a pressure differential in the hose termination unit.

Embodiments of the fourteenth aspect of the invention may include one or more features of the first to thirteenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
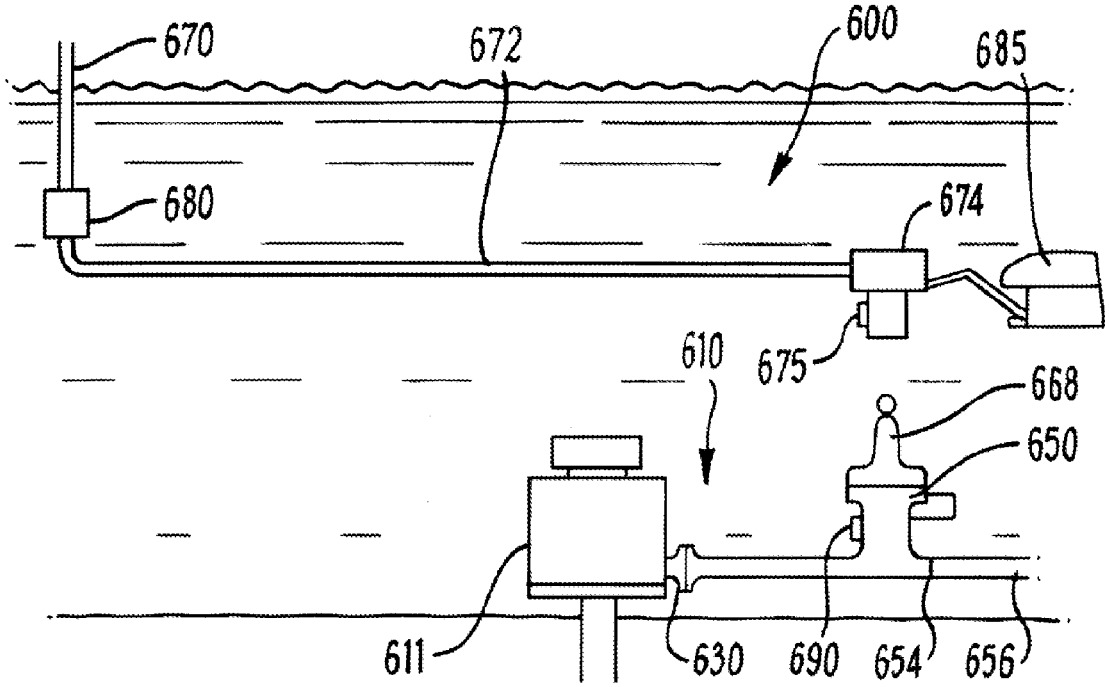
FIGS. 1A and 1B show schematically a subsea system in accordance with an embodiment of the invention, used in successive stages of a well squeeze operation.
Figure 1B:
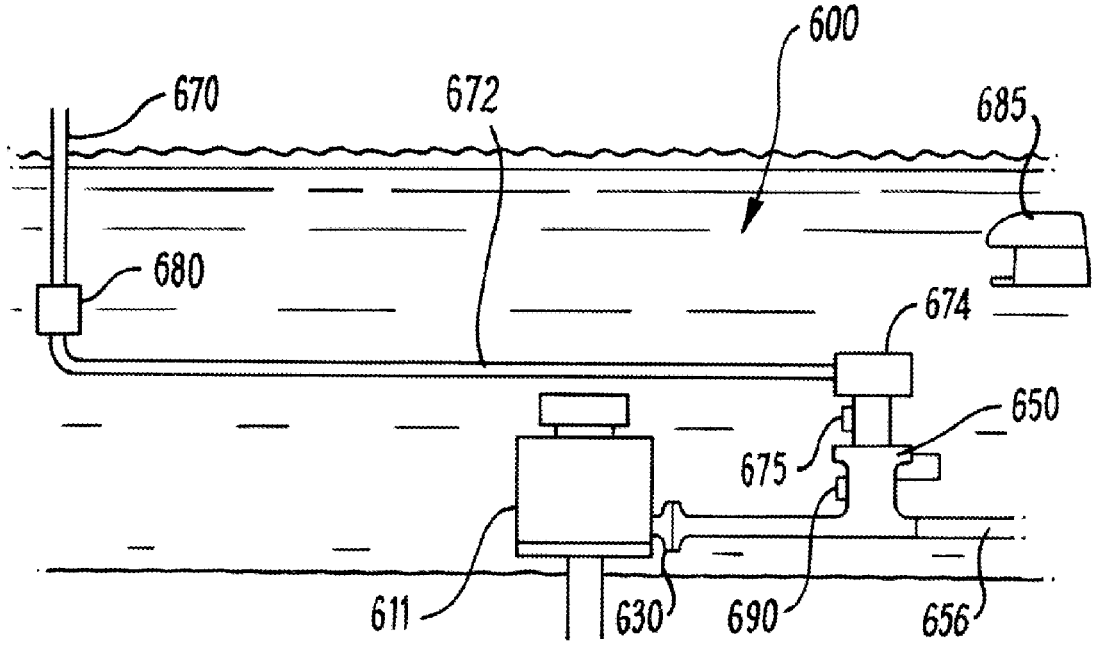
Figure 2A:
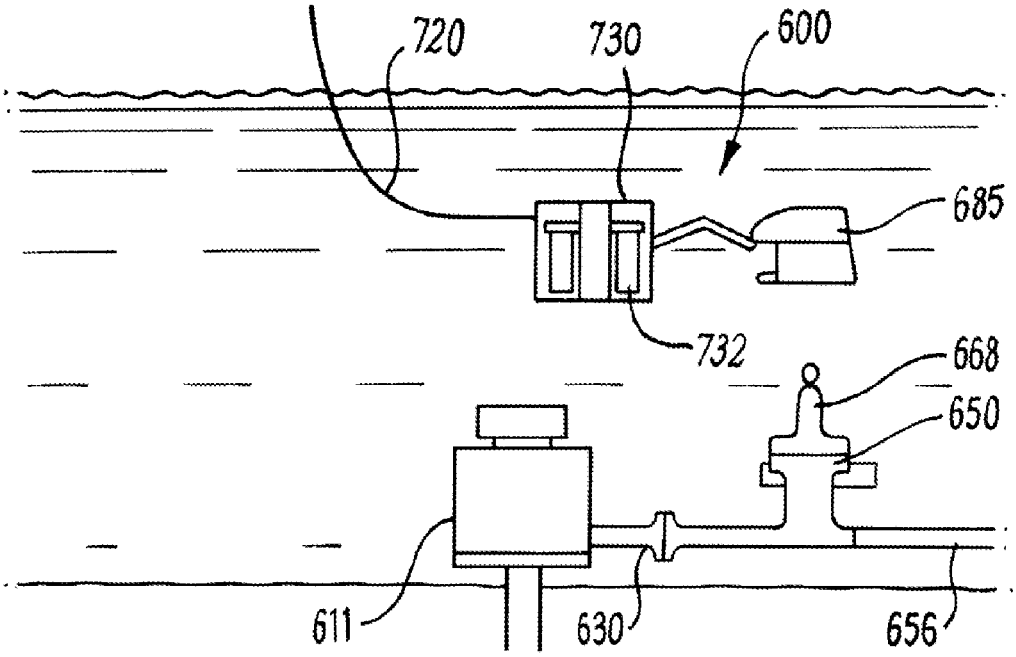
FIGS. 2A and 2B show schematically the subsea system of FIGS. 1A and 1B used in successive stages of a production fluid sample operation.
Figure 2B:
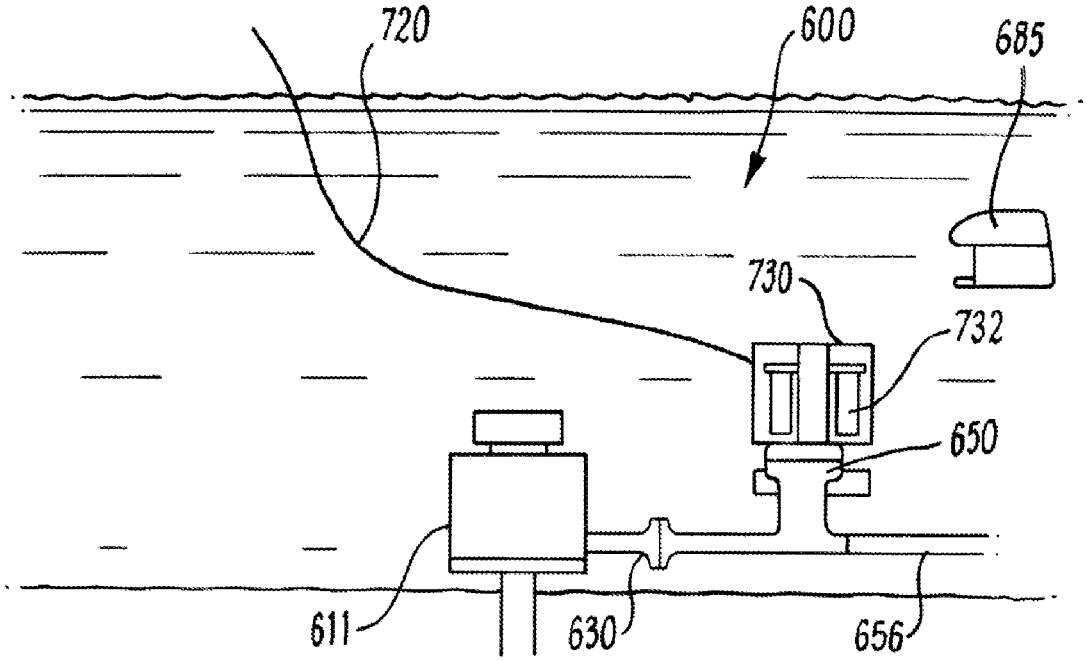
Figure 3:
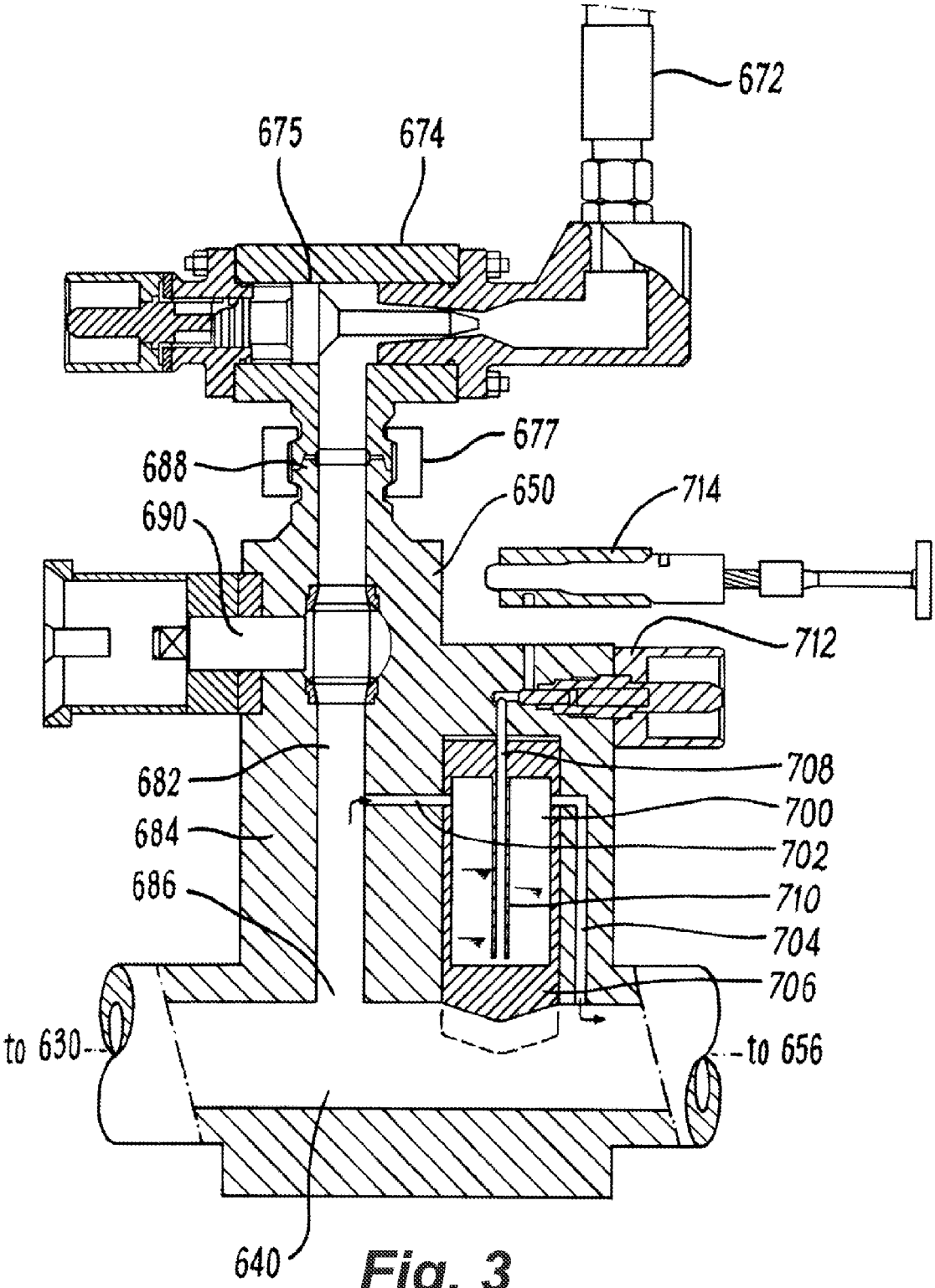
FIG. 3 is a sectional view of a combined injection and sampling hub used in the systems of FIGS. 1 and 2, when coupled to an injection hose connection.

Referring firstly to FIGS. 1 to 3, a combined injection and sampling system will be described. The system, generally depicted at 600, is shown schematically in different stages of a subsea injection operation in a well squeeze application in FIGS. 1A and 1B and in a sampling mode as described below with reference to FIGS. 2A and 2B. A hub 650, configured as a combined sampling and injection hub used in the methods of FIGS. 1 and 2, is shown in more detail in FIG. 3.

The system 600 comprises a subsea flow system 610 which includes subsea manifold 611. The subsea manifold 611 is a conventional vertical dual bore Christmas tree (with internal tree components omitted for simplicity), and the system 600 utilises a hub 650 to provide access to the flow system 610. A flowline connector 630 of a production branch outlet conduit (not shown) is connected to the hub 650 which provides a single access point to the system. At its opposing end, the hub 650 comprises a standard flowline connector 654 for coupling to a conventional jumper 656. In FIG. 1A, the hub 650 is shown installed with a pressure cap 668. Optionally a debris and/or insulation cap (not shown) may also be provided on the pressure cap 668.

The system 600 also comprises an upper injection hose 670, deployed from a surface vessel (not shown). The upper injection hose 670 is coupled to a subsea injection hose 672 via a weak link umbilical coupling 680, which functions to protect the subsea equipment, including the subsea injection hose 672 and the equipment to which it is coupled from movement of the vessel or retrieval of the hose. The subsea injection hose 672 is terminated by a hose connection termination 674 which is configured to be coupled to the hub 650. The hub 650 is configured as a combined sampling and injection hub, and is shown in more detail in FIG. 3 (in a condition connected to the hose connection 674 in the mode shown in FIG. 1B).

As shown most clearly in FIG. 3, the hose connection termination 674 incorporates a hose connection valve 675, which functions to shut off and regulate injection flow. The hose connection valve 675 in this example is a manual choke valve, which is adjustable via an ROV to regulate injection flow from the hose 672, through the hose connection 674 and into the hub 650. The hose connection 674 is connected to the hub via an ROV style clamp 677 to a hose connection coupling 688.

The hub 650 comprises an injection bore 682 which extends through the hub body 684 between an opening 686 from the main production bore 640 and the hose connection coupling 688. Disposed between the opening 688 and the hose connection coupling 688 is an isolation valve 690 which functions to isolate the flow system from injection flow. In this example, a single isolation valve is provided, although alternative embodiments may include multiple isolation valves in series. The isolation valve 690 is a ball valve, although other valve types (including but not limited to gate valves) may be used in alternative embodiments of the invention. The valve 690 is designed to have a fail-safe closed condition (in embodiments with multiple valves at least one should have a fail-safe closed condition).

The hub 650 is also provided with a sampling chamber 700. The sampling chamber comprises an inlet 702 fluidly connected to the injection bore 682, and an outlet 704 which is in fluid communication with the main production bore 640 downstream of the opening 686. The sampling chamber 700 is provided with an end effector 706, which may be pushed down into the flow in the production bore 640 to create a hydrodynamic pressure which diverts flow into the injection bore 682 and into the sampling chamber 700 via the inlet 702. Fluid circulates back into the main production bore via the outlet 704.

In an alternative configuration the inlet 702 may be fluidly connected directly to the production bore 640, and the end effector 706 may cause the flow to be diverted into the chamber 700 directly from the bore 640 via the inlet.

The sampling chamber 700 also comprises a sampling port 708, which extends via a stem 710 into the volume defined by the sampling chamber. Access to the sampling port 708 is controlled by one or more sampling needle valves 712. The system is configured for use with a sampling hot stab 714 and receptacle which is operated by an ROV to transfer fluid from the sampling chamber into a production fluid sample bottle (as will be described below with reference to FIGS. 2A and 2B).

The operation of the system 600 in an application to a well squeeze operation will now be described, with reference to FIGS. 1A and 1B. The operation is conveniently performed using two independently operated ROV spreads, although it is also possible to perform the operation with a single ROV. In the preparatory steps a first ROV (not shown) inspects the hub 650 with the pressure cap 668 in place, in the condition as shown in FIG. 1A. Any debris or insulation caps (not shown) are detached from the hub 650 and recovered to surface by the ROV. The ROV is then used to inspect the system for damage or leaks and to check that the sealing hot stabs are in position. The ROV is also used to check that the tree and/or jumper isolation valves are closed. Pressure tests are performed on the system via the sealing hot stab (optionally a full pressure test is performed), and the cavity is vented. The pressure cap 668 is then removed to the ROV tool basket, and can be recovered to surface for inspection and servicing if required.

The injection hose assembly 670/672 is prepared by setting the weak link coupling 680 to a locked position and by adjusting any trim floats used to control its buoyancy. The hose connection valve 675 is shut off and the hose is pressure tested before setting the hose pressure to the required deployment value. A second ROV 685 is deployed below the vessel (not shown) and the hose is deployed overboard to the ROV. The ROV then flies the hose connection 674 to the hub 650, and the connection 674 is clamped onto the hub and pressure tested above the isolation valve 690 via an ROV hot stab. The weak link 680 is set to its unlocked position to allow it to release the hose 670 from the subsea hose 672 and the hub 650 in the event of movement of the vessel from its location or retrieval of the hose.

The tree isolation valve is opened, and the injection hose 672 is pressurised to the desired injection pressure. The hose connection valve 675 is opened to the desired setting, and the isolation valve is opened. Finally the production wing isolation valve is opened to allow injection flow from the hose 672 to the production bore to commence and the squeeze operation to be performed. On completion, the sequence is reversed to remove the hose connection 674 and replace the pressure cap 668 and any debris/insulation caps on the hub 650.

It is a feature of this aspect and embodiment of the invention that the hub 650 is a combined injection and sampling hub; i.e. the hub can be used in an injection mode (for example a well squeeze operation as described above) and in a sampling mode as described below with reference to FIGS. 2A and 2B.

The sampling operation may conveniently be performed using two independently operated ROV spreads, although it is also possible to perform this operation with a single ROV. In the preparatory steps, a first ROV (not shown) inspects the hub 650 with its pressure cap 668 in place (as shown in FIG. 2A). Any debris or insulation cap fitted to the hub 650 is detached and recovered to surface by a sampling Launch and Recovery System (LARS) 720. The ROV is used to inspect the system for damage or leaks, and to check that the sealing hot stabs are in position.

The sampling LARS 720 subsequently used to deploy a sampling carousel 730 from the vessel (not shown) to depth and a second ROV 685 flies the sampling carousel 730 to the hub location. The pressure cap 668 is configured as a mount for the sampling carousel 730. The sampling carousel is located on the pressure cap locator, and the ROV 685 indexes the carousel to access the first sampling bottle 732. The hot stab (not shown) of the sampling bottle is connected to the fluid sampling port 708 to allow the sampling chamber 700 to be evacuated to the sampling bottle 732. The procedure can be repeated for multiple bottles as desired or until the bottles are used.

On completion, the sample bottle carousel 730 is detached from the pressure cap 668 and the LARS 720 winch is used to recover the sample bottle carousel and the samples to surface. The debris/insulation cap is replaced on the pressure cap 668, and the hub is left in the condition shown in FIG. 2A.

Figure 4:
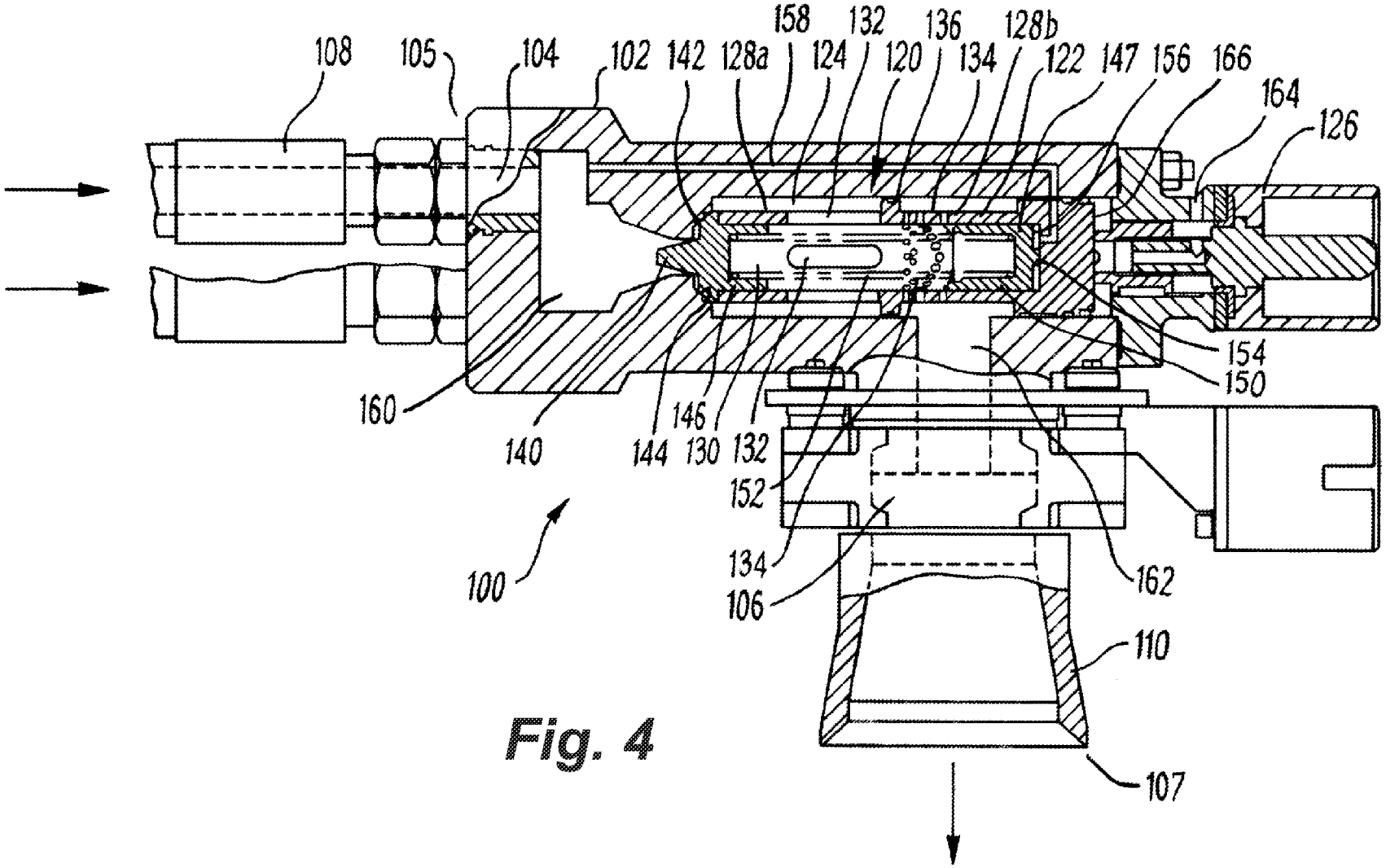
FIG. 4 is a part-sectional view of a hose connection termination apparatus which may be used with the combined injection and sampling hub of FIG. 3 in an embodiment of the invention.

The embodiment described with reference to FIG. 3 has a particular configuration of a combined injection and sampling unit, but other configurations are within the scope of the invention. FIG. 4 is a part-sectional view through a hose connection termination, generally shown at 100, which may be used in an alternative embodiment. The hose connection termination 100 will be described in the context of a combined injection and sampling application, for example used in the configuration of FIG. 3 in place of the hose connection termination 674. However, it will be appreciated that the hose connection termination 100 may be used in alternative applications, and in particular for general injection applications in which the hose connection termination 100 is connected into a subsea flow system.

The hose connection termination 100 comprises a housing 102, a hose connection opening 104 at a hose end 105, and a flow system port 106 at a flow system end 107. The hose connection opening 104 in this embodiment is a termination point for a three hose injection umbilical 108, which is analogous to subsea injection hose 672 in FIG. 1. The individual hoses which make up the umbilical can be readily formed into to a flexible umbilical with additional hydraulic and electrical control conduits and conductors, and strength members. The port 106 is configured to be connected to an opening to the flow system, which in this case is an opening 688 to hub 650. A hose termination guidance funnel 110 facilitates the location of the hose termination connection 100 on the hub 650. In this embodiment, the port 106 is vertically-oriented for connection to a vertically-facing opening 688 to the flow system 610, and the hose connection opening 104 is horizontally-oriented, although other configurations are within the scope of the invention as will be understood by one skilled in the art.

The housing 102 accommodates a hose connection valve assembly 120, which is generally referred to as a flow control valve. The valve assembly 120 performs the functions of (a) a flow shut-off valve; (b) a back flow prevention or check valve; (c) an automatic flow-rate control valve; and (d) an injection hose anti-collapse valve. The feature and functions of the valve will be described in more detail below.

The valve assembly 120 comprises a choke sleeve assembly 122 located axially within a valve bore 124 in the housing 102. The axial position of the choke sleeve assembly 122 is controlled by the torque bucket stem 126, which is configured for operation by an ROV (not shown). The choke sleeve assembly 122 comprises a cylindrical sleeve 128 oriented axially in the housing 102 and defining an internal bore 130. A first portion of the sleeve 128*a*, disposed towards the hose end 105, comprises a number of radial slots 132 circumferentially spaced around the cylindrical sleeve 122. A second portion 128*b* of the sleeve, disposed away from the hose opening 104 and towards the flow system end 106, comprises a plurality of radial valve ports 134. The radial valve ports 134 are distributed circumferentially and axially around the portion 128*b* of the sleeve 128. The choke sleeve assembly 122 also comprises an annular valve seal 136 which separates the first portion 128*a* and the second portion 128*b* on the exterior of the sleeve 128.

A mandrel portion 137 of the choke sleeve assembly 128 defines one end of the sleeve assembly, away from the hose end 105. The sleeve assembly 122 also comprises a check poppet 138 located at a leading end of the choke sleeve assembly (towards the hose end 105). The check poppet 138 comprises a valve member 140 having frusto-conical nose portion and frusto-conical shoulder 142 which corresponds in shape to a poppet valve seat 144 in the housing 102. The poppet 138 also comprises a cylindrical body 146 which is received in the choke sleeve 128. A shoulder on the poppet abuts the end of the choke sleeve to prevent its retraction into the sleeve. The poppet 138 is slidable in the choke sleeve 128 to extend the effective length of the choke sleeve assembly 122, as will be described below.

The choke sleeve assembly 122 also comprises a spool 150 located in the internal bore 130. A compression spring 152 located in the internal bore between the poppet 138 and the spool 150 biases the spool 150 towards the end of the choke sleeve assembly (i.e. away from the hose end). The mandrel portion 147 of the choke sleeve assembly defines one end of the internal bore 130, and the spool comprises an abutment protrusion 154 to create a spool pressure chamber 156 between the face of the spool and the mandrel. The housing 102 also comprises a fluid pressure conduit 158 which connects a hose manifold chamber 160 with the spool pressure chamber 156. An alternative embodiment may include independent springs, one each for the poppet 138 and the spool 150, to provide independent control of the biasing forces on the poppet and spool.

Operation of the flow control valve 120 in an injection operation will now be described.

During installation, the port 106 is connected to an opening 688 of a hub 650, in the manner described with reference to FIG. 1A, with the hose 108 connected, via a weak link 680 to an upper injection hose 670. With the torque bucket stem 126 fully closed (i.e. turned fully clockwise), the choke sleeve assembly 122 is moved towards the hose opening in the valve bore 124, such that the poppet 138 engages the valve seat 144 and flow from the hose opening 104 to the port 106 is prevented.

Subsequent opening of the torque bucket stem 126 (e.g., by anti-clockwise turning) allows the choke sleeve assembly to open (moving to the right as drawn in FIG. 4). The spring 152 forces the sleeve away from the hose end and separates the poppet and sleeve. With the choke assembly 122 retracted, the poppet 138 and the valve seat 144 define an adjustable orifice for flow from the hose end 108 to the opening 106. It will be understood that by turning the torque bucket stem 126 clockwise or anti-clockwise, the orifice defined between the poppet and the valve seat can be finely adjusted to set the flow rate through the valve 120.

During injection, fluid flow from the injection hose 108 passes into the hose manifold chamber 160, through the orifice between the poppet 138 and the valve seat 144, and into the valve bore 124. Continued axial flow of the fluid in the valve bore 124 is prevented by the annular valve seal 136. Injection fluid passes into the internal bore 130 via the radial slots 132 and passes axially in the internal bore from the first portion 128*a* to the second portion 128*b*. In the second portion 128*b*, injection fluid passes out of the radial valve ports 134, into the port bore 162, and out of the hose termination connection 100 into the hub 650.

In use, the pressure drop across the valve orifice defined by the valve member 140 and the valve seat 144 is sensed at each of the spool 150, due to the fluid pressure conduit 158 which connects the hose manifold chamber 160 and the spool pressure chamber 156. Therefore, the net axial force on the spool 150 is dependent on the pressure drop across the valve orifice. If the pressure drop increases (for example the reservoir starts to "draw or suck" injection fluid), the pressure in the internal bore 130 will decrease, and there will be an increased axial force on the spool 150 towards the hose end. When this force is sufficient to overcome the biasing force of the spring 152, the spool 150 will move towards the hose and (i.e. from right to left in FIG. 4 as drawn). This causes the spool 150 to close a proportion of the radial flow ports 134 in the choke sleeve 128, and regulate the flow of injection fluid through the valve 120. Thus, the valve provides automatic flow control in the event of reservoir drawing or sucking of injection fluid.

Conversely, if the pressure in the reservoir increases, the pressure drop across the valve orifice decreases, and the force on the spool towards the hose end 105 reduces, such that the biasing force from the spring 152 pushes the spool away from the hose end to open the radial valve ports 134 in the sleeve and increase the flow rate through the valve 120.

The automatic flow control of this embodiment of the invention is particularly beneficial for the convenient and cost-effective performance of the subsea fluid injection operation, such as are performed during well squeeze processes. The automatic flow control maintains pressure upstream of the valve in the event that the reservoir starts to draw or suck during the injection operations. This means that the fluid supply hoses need not be specified as collapse resistant to external pressure. This has the effect of reducing the hose size and cost.

This embodiment of the invention also includes an ambient pressure vent 164, located in the valve housing 102 and in fluid communication with a face 166 of the choke sleeve assembly 122. In use, if the pressure in the flow system 610 drops to a pressure below the ambient hydrostatic pressure, the pressure differential will effect a force on the face 166 of the choke assembly 122 which pushes the entire choke sleeve assembly towards the hose end 105 (i.e. to the left as drawn in FIG. 4) until the check poppet 138 engages with the valve seat to close the orifice. This arrangement provides a convenient safeguard against hose collapse due to external pressure, even in a situation where a positive pressure differential from the upstream side of the valve to the downstream flow system is maintained.

The valve 120 also functions as a back flow prevention or check valve. In use, if the reservoir pressure exceeds the pressure in the hose, it may begin to cause reverse flow (or "spit back") during the injection process. In the valve 120, reverse flow is prevented by sliding the movement of the check poppet 138 into engagement with the valve seat 144 to close the orifice.

The hose connection termination 100 of this embodiment performs multiple flow control functions into a single unit which is compact in size and low in weight. This is significant advantage for subsea intervention applications, as the small and light unit can be conveniently and safely deployed using ROVs. The apparatus can be deployed from relatively small vessels and significantly reduces the risk of damaging installed infrastructure. These factors combine to provide a cost-effective intervention operation.

Furthermore, as described above, the automatic flow control and/or external pressure protection maintain pressure upstream of the valve in the event that the reservoir starts to draw or suck during the injection operations, or if the overall pressure in the hose drops. This means that the fluid supply hoses need not be specified as collapse resistant to external pressure, which has a large effect on hose size. A reduced hose size positively impacts on the convenience, safety and cost of the deployment operation, and also has a significant impact on the capital cost of the hose (for example, a non-collapse resistant hose may be around 25% lower in cost). Non-collapse resistant hoses are also more readily available than collapse resistant variants.

Figure 5:
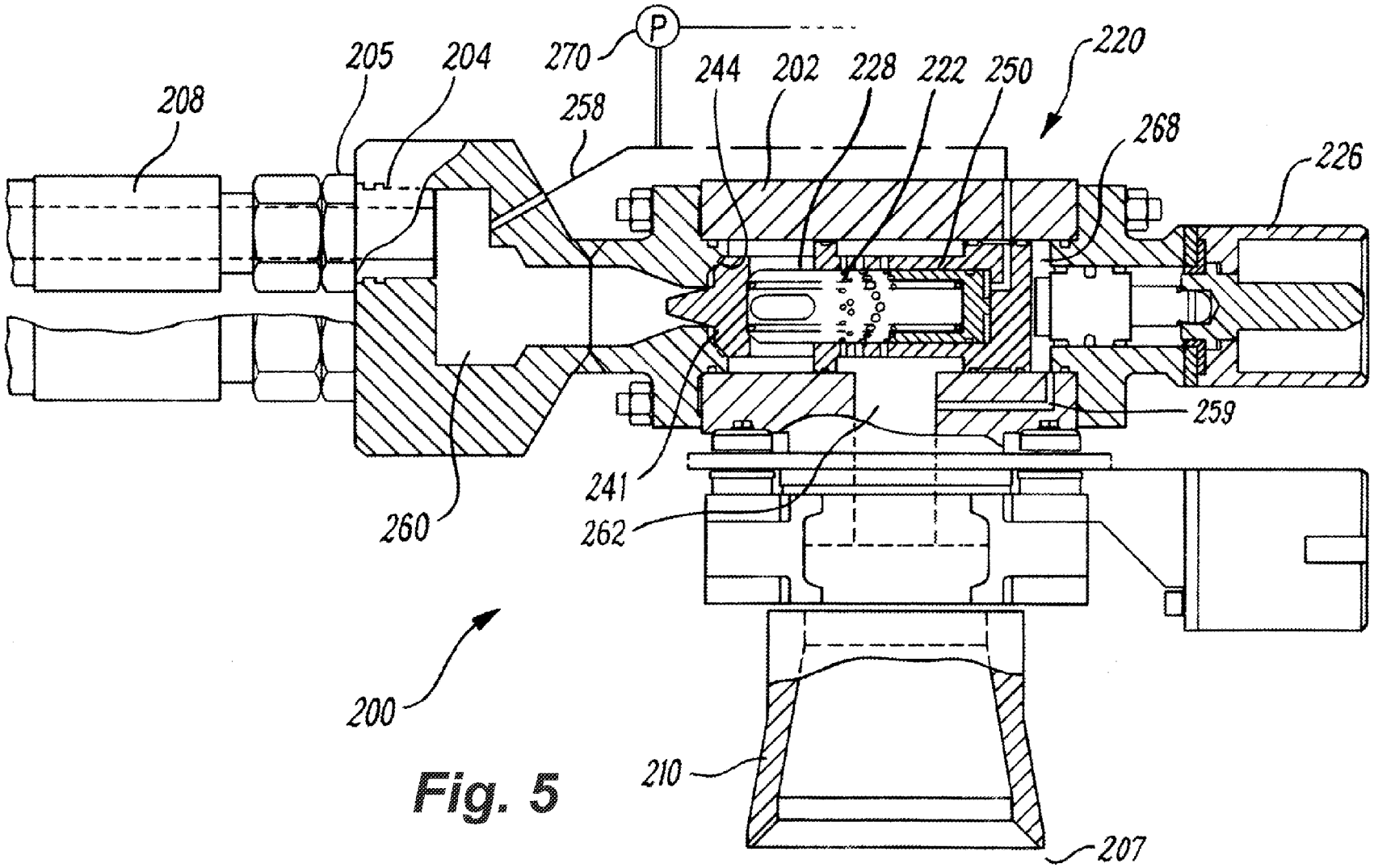
FIG. 5 is a part-sectional view of an alternative hose connection termination apparatus which may be used with the combined injection and sampling hub of FIG. 3 in an alternative embodiment of the invention.

FIG. 5 is a part-sectional view of a hose connection termination apparatus, generally shown at 200, in accordance with an alternative embodiment of the invention. The hose connection termination 200 is similar to the hose connection termination 100, and its features and operation will be understood from FIG. 4 and the accompanying description. Like features are given like reference numerals incremented by 100. However, the hose connection termination 200 differs in the nature of the valve 220 as described below.

The valve assembly 220 comprises an adjustable valve orifice defined by a valve seat 244 of the housing 202 and a valve member of the choke sleeve assembly 222. In place of the sliding anti back flow check poppet 138 of valve 100, valve 200 comprises a valve member 241 which is integrated and axially keyed with the choke sleeve assembly 222. The automatic flow control and flow shut-off functionality of the valve 220 function is essentially identical to that of the valve 120. However, in the absence of a sliding poppet 138, the back flow prevention functionality is achieved by the provision of a fluid pressure control conduit 259 between the port bore 262 and a choke assembly pressure chamber 268. An increase in reservoir pressure to a level which exceeds the pressure in the upstream part of the valve 220 effects a force on the end of the choke assembly mandrel which causes the choke sleeve assembly to move towards the hose end 205 and engage the valve member 241 on the valve seat 244.

Hose connection termination 200 also differs from the embodiment of FIG. 4 by the absence of an ambient pressure vent in the housing. In some embodiments, this feature may be dispensed with. However, in this embodiment, protection against hose collapse due to external pressure is provided by use of a pressure sensor 270 which detects the pressure in the upstream part of the apparatus 200. The pressure sensor 270 delivers an output which is used to control an isolation valve (690 in FIG. 3), such that if the pressure in the apparatus 200 is detected to be lower than an external ambient pressure (or alternatively within a predetermined threshold of the external ambient pressure or below a predetermined value) the isolation valve 690 is closed to flow through the apparatus 200 and increase pressure in the hose 208. In a preferred embodiment, the isolation valve 690 has a failsafe close condition, and in response to an output from the pressure sensor, the control signal to the isolation valve is interrupted to cause the valve to close.

It will be appreciated that the use of a pressure sensor to provide a low hose pressure signal which causes the isolation valve to close (as described above) may also be used with other embodiments of the invention including the hose connection termination apparatus 100 as described within relation to FIG. 4.

Figure 6:
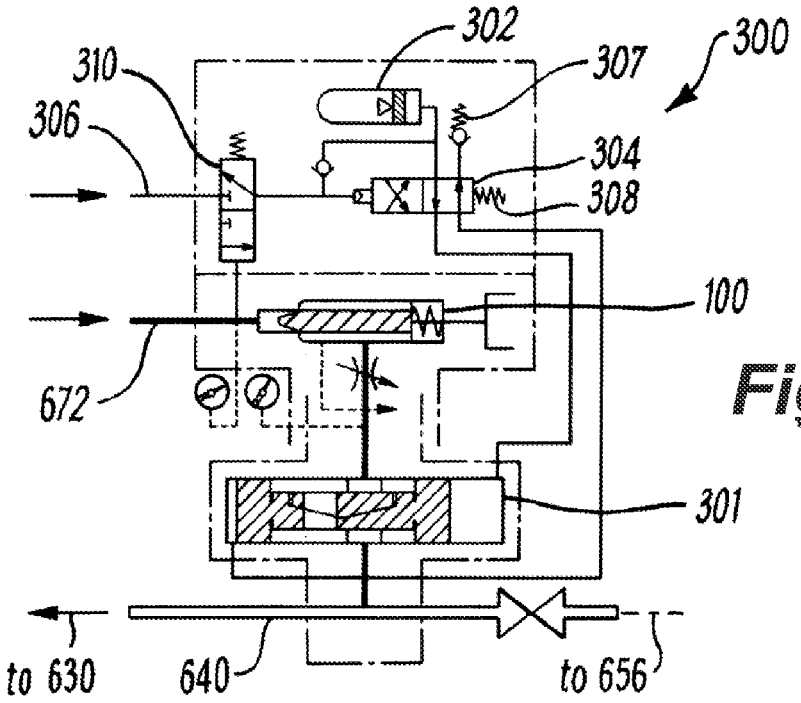
FIG. 6 is a schematic view of an isolation valve control circuit which may be used with the combined injection and sampling systems of any of FIGS. 3 to 5.

Referring now to FIG. 6, there is shown a schematic view of an exemplary isolation valve control circuit, generally shown at 300, which may be used with an injection system as described with reference to any of FIGS. 3 to 5. In this example, the circuit 300 uses a hydraulic signal from surface to control the operation of the isolation valve 301. In this embodiment the isolation valve 301 is an expanding gate valve, rather than the ball valve 690 shown in the previous embodiments.

The control circuit 300 comprises an accumulator 302 configured to open and close the isolation valve 301 by means of a hydraulic directional control valve 304. A hydraulic control line 306 from surface charges the accumulator 302 and operates the valve 304. The valve 304 includes a spring 308 to pre-load the valve 304 to a condition in which the isolation valve 301 is closed. A vent 307 is coupled to the opposing side of the isolation valve 301. In this embodiment, the circuit 300 also includes a positive hose pressure interlock 310, responsive to a pressure condition in the hose termination connection apparatus 100. In the condition shown in FIG. 6, the positive hose pressure interlock 310 is biased to a closed position to interrupt the control signal to the valve 304 and keep the valve 301 closed. In a positive pressure condition the interlock 310 permits the hydraulic control signal to the valve 304, to move it to a condition (not shown) in which the isolation valve is opened.

Figure 7:
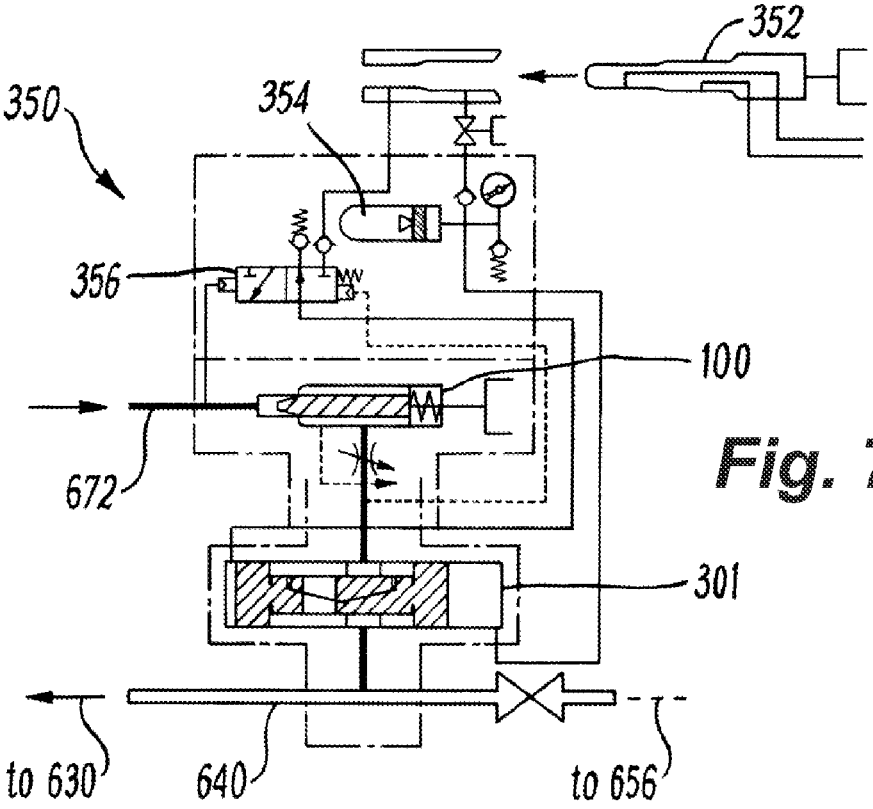
FIG. 7 is schematic view of an isolation valve control circuit which may be used with the combined injection and sampling systems of any of FIGS. 3 to 5.

FIG. 7 is a schematic view of an exemplary isolation valve control circuit, generally shown at 350, which may also be used with an injection system as described with reference to any of FIGS. 3 to 5. In the control circuit 350, the accumulator 354 is charged by ROV hot stab 352, rather than from surface. In an initial condition, the isolation valve 301 is closed. The ROV test hot stab 352 provides hydraulic fluid to charge the accumulator 354 and open the isolation valve 301. However, the directional control valve 356 is responsive to injection flow pressure in the upstream part of the hose. In the absence of a positive injection pressure differential, the valve 356 is in a condition (as shown in FIG. 7) which closes the isolation valve 301. With a positive injection pressure differential, the valve 356 is in a condition which allows the ROV hot stab 352 to open the isolation valve 301.

Figure 8:
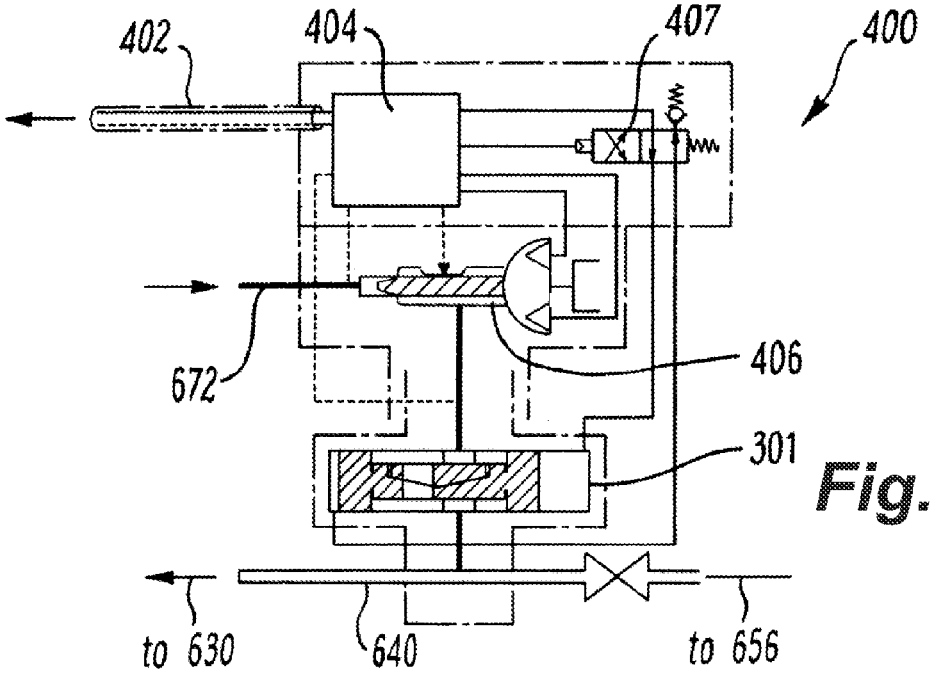
FIG. 8 is a schematic view of an isolation and choke valve control circuit according to an embodiment of the invention which may be used with the combined injection and sampling systems of FIGS. 3 to 5.

FIG. 8 is a schematic view of another exemplary isolation valve control circuit, generally shown at 400, which may also be used with an injection system as described with reference to any of FIGS. 3 to 5. In this embodiment, the control circuit 400 utilises electro-hydraulic subsea processing with electrical and hydraulic signals to and from the surface via umbilical 402. A subsea control module 404 receives electronic and hydraulic control signals from the umbilical 402. The flow control valve 406 is an industry standard subsea hydraulic choke valve (analogous to that shown in FIG. 3 at reference number 675), and the subsea control module 404 monitors the pressure and flow conditions in the valve 406. The valve 407 is controlled by the subsea control module 404 to operate the isolation valve 301 in response to signals from electrical sensors in the valve 406 and flow system 610.

Figure 9:
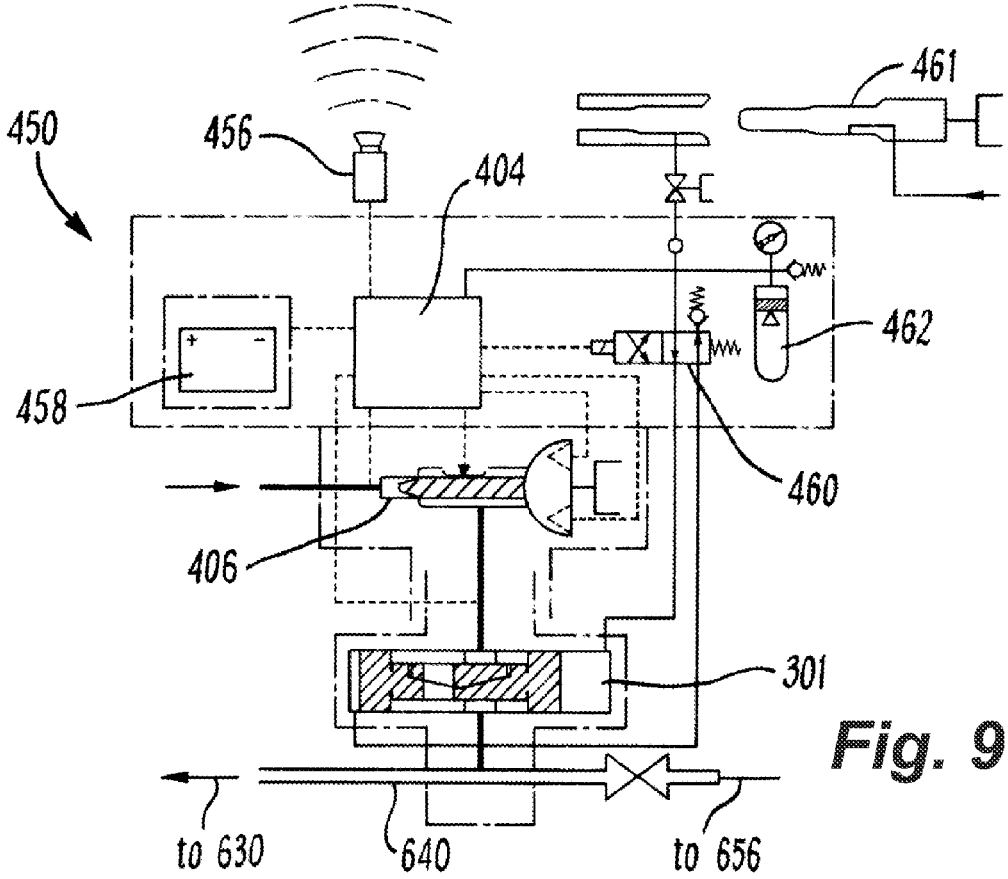
FIG. 9 is a schematic view of an isolation and choke valve control circuit according to an alternative embodiment of the invention, which may be used with the combined injection and sampling systems of FIGS. 3 to 5.

FIG. 9 is a schematic view of another exemplary isolation valve control circuit, generally shown at 450, which may also be used with an injection system as described with reference to any of FIGS. 3 to 5. The circuit 450 is similar to the circuit 400, and will be understood from FIG. 8 and the accompanying description. However, in the circuit 450 the communication between the subsea control module 454 and surface is achieved by an acoustic signal between a subsea transceiver 456 coupled to the subsea control module 454 and a transceiver (not shown) located at the surface. In this embodiment, as there is no hydraulic or electrical communication from surface, the circuit 450 comprises a subsea electrical power source in the form of a battery 458 connected to the subsea control module 454. The directional control valve 460 in this embodiment is electrical rather than hydraulic, and is activated in response to signals from the subsea control module 454. As with the circuit 350 of FIG. 7, the ROV test hot stab 461 provides hydraulic fluid to charge the accumulator 462 to open the isolation valve (in contrast to the embodiments of FIGS. 6 and 8 which use hydraulic fluid from surface).

Figure 10A:
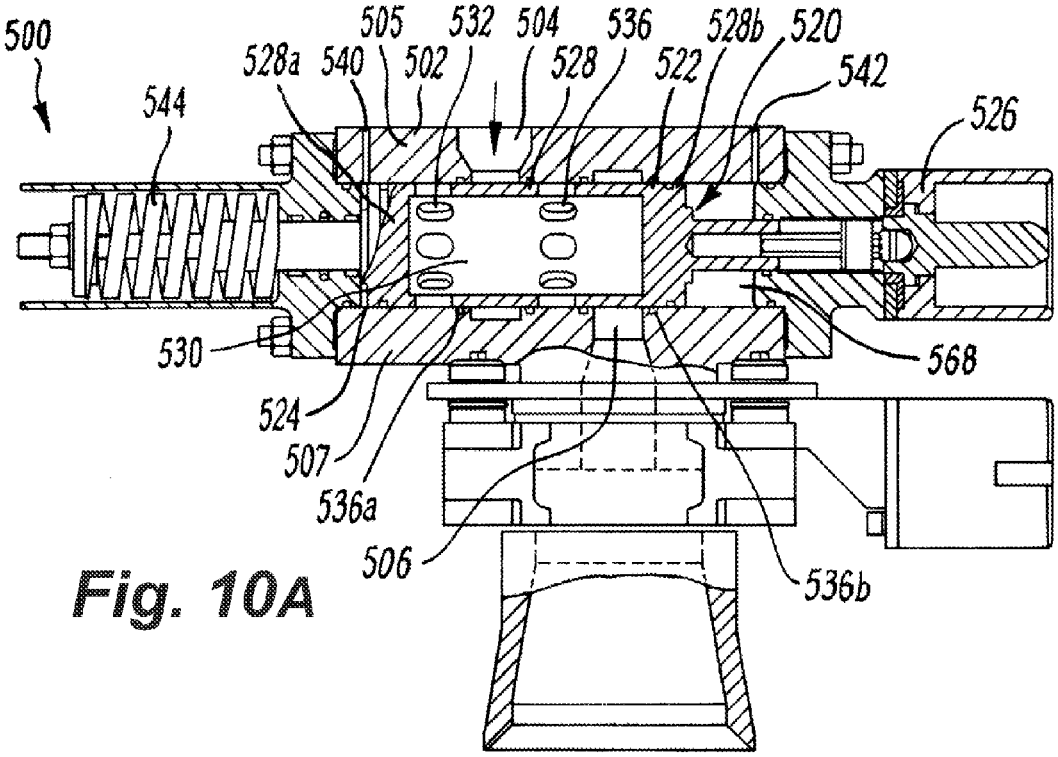
FIG. 10A is a part-sectional view of a hose connection termination apparatus which may be used with the combined injection and sampling hub of FIG. 3 in an alternative embodiment of the invention, shown in a closed condition.
Figure 10B:
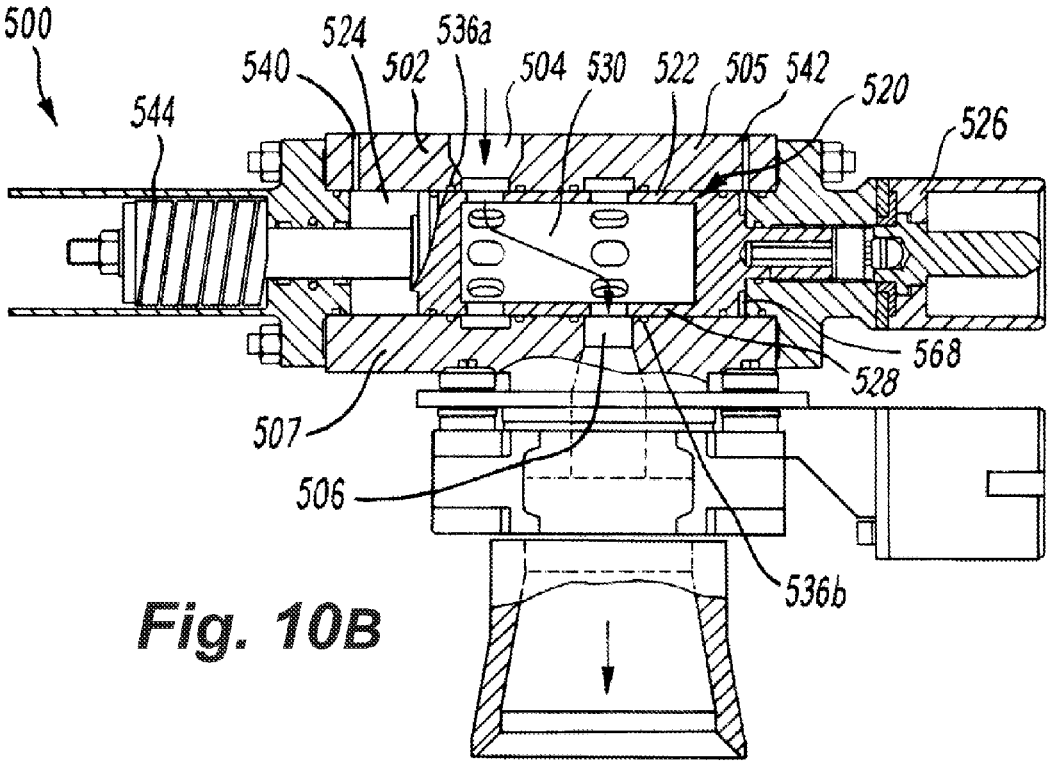
FIG. 10B is a part-sectional view of the hose connection termination apparatus of FIG. 10A in an alternative embodiment of the invention, shown in an open condition.

Referring now to FIGS. 10A and 10B, there is shown a part-sectional view of a hose connection termination apparatus, generally shown at 500, in accordance with an alternative embodiment of the invention. The hose connection termination 500 is similar to the hose connection terminations 100 and 300, and its features and operation will be understood from FIGS. 4 and 5 and the accompanying description. Like features are given like (incremented) reference numerals. However, the hose connection termination 500 differs as described below.

The hose connection termination 500 comprises a housing 502, and a radial hose connection opening 504 at an upper portion 505, and a flow system port 506 at a lower portion 507. The hose connection opening 504 in this embodiment is a termination point for a single hose, which is analogous to subsea injection hose 672 in FIG. 1.

The housing 502 accommodates a hose connection valve assembly 520, which is generally referred to as a flow control valve. The valve assembly 520 is able to perform the same key functions as the valves of FIGS. 4 and 5, as will be described in more detail below.

The valve assembly 520 comprises a spool assembly 522 located axially within a valve bore 524 in the housing 502.

The axial position of the spool assembly 522 when in an open condition, as shown in FIG. 10B, is controlled by the torque bucket stem 526, which is configured for operation by an ROV (not shown). The spool assembly 522 comprises a cylindrical sleeve 528 oriented axially in the housing 502 and defining an internal bore 530. A first portion of the sleeve 528*a*, disposed towards the hose end, comprises a number of radial ports 532 circumferentially spaced around the cylindrical sleeve 522. A second portion 528*b* of the sleeve, disposed away from the hose opening 504 and towards the flow system port 506, comprises a plurality of radial valve ports 534 distributed circumferentially and axially around the sleeve 128. Elastomeric seals 536*a*, 536*b* are provided around the openings 504, 506, and prevent passage of fluid through the valve other than through the bore 530 of the sleeve 528 via the ports 532, 534.

The valve assembly 520 is pressure balanced, having a pair of pressure ports 540, 542, connected to an external hydraulic control circuit. The hydraulic control circuit (not shown) is operable to control the position of the sleeve 528 within the housing 502 between the fully closed position (FIG. 10A) and the open position (FIG. 10B) set by the torque bucket stem 526. The hydraulic control circuit utilises electro-hydraulic subsea processing with electrical and hydraulic signals to and from the surface via an umbilical and a subsea control module and may, for example, be functionally equivalent to the part of the control circuit 400 of FIG. 8 which controls the position of the valve 406. The hydraulic control circuit provides automatic flow control for the valve assembly 520, with the position of the sleeve of the valve being controlled in dependence on pressure sensed in the hose, the valve housing, and/or the flow system.

In use, the sleeve 532 is biased towards its closed position (FIG. 10A) by the failsafe close spring 544, and the closed position may be backed up by closing the torque bucket stem 526. The torque bucket stem is opened to set the maximum open position of the valve (with the spool in its leftmost, closed position). The maximum open position of the valve can be adjusted by the torque bucket stem 526 to limit the flow of fluid through the valve. In this embodiment, the radial ports are slightly elongated but arranged in a ring around the sleeve. However, it will be appreciated other configurations of radial ports may be used, for example a distribution of smaller ports (such as those in the valves of FIGS. 4 and 5) may be more suitable if a fine degree of flow control (or choking) is desirable in a particular application.

During operation, fluid can be injected into the flow system by using the hydraulic circuit to open the valve to an open or partially open condition. The hydraulic control circuit provides automatic flow control for the valve assembly 520, with the position of the sleeve of the valve being controlled in dependence on pressure sensed in the hose, the valve housing, and/or the flow system. If required for operational reasons, the valve 520 may quickly be closed by operating the hydraulic control circuit.

Amongst the benefits of the valve assembly of FIGS. 10A and 10B is that it can be actuated to open and close with a relatively low hydraulic power, due to the use of a pressure balanced valve. In addition, the valve provides full fluid shut-off functionality in the hose termination without relying on the use of an additional shut-off valve (such as valve 301) in the hub or flow system itself. This has the advantage that the shut-off valve control may be via the hose umbilical, and it is not necessary to run additional control lines to the hub or flow system.

Variations to the valve assembly of FIGS. 10A and 10B may be made within the scope of the invention, and in particular, features of the valve assemblies 120 and 220 may be incorporated in the valve 520. For example, the chamber 568 may be connected to the flow system well pressure via a pressure control conduit, similar to the manner described with reference to FIG. 5, to provide back flow prevention functionality. An increase in reservoir pressure to a level which exceeds the pressure in the upstream part of the valve 520 effects a force on the end of the spool assembly which causes the spool assembly to move towards the closed position and shut off flow. Back flow prevention poppets may also be included in the valve assembly (integrated into the spool or provided in a sub assembly between the hose and the termination apparatus). A variety of radial port patterns and spool designs may be used, including spool sleeves which seal only around one of the openings 504, 506. Vertical and/or inverted sleeve arrangements may have advantages connected to manufacturing costs and/or effective use of space when fitted to the flow system.

In another embodiment (not illustrated) a hose termination includes a valve assembly which is similar to that shown in FIGS. 10A and 10B, but which is not pressure balanced. Instead, the chamber 568 is connected to the flow system, and there is a single hydraulic control port on the opposing side of the spool. A hydraulic line may be connected to the hydraulic control port to increase the pressure on one side of the spool to a pressure greater than reservoir pressure to open the valve. Optionally, the hydraulic line is acoustically controlled. In a further variation, the hydraulic control port is linked to injection pressure in the subsea hose, to ensure that the valve is only opened when reservoir pressure is less than the hose pressure (therefore preventing hose collapse).

The invention provides a flow control valve for a subsea hydrocarbon production system and a method of use. The flow control valve comprises an inlet configured to be in fluid communication to an injection fluid conduit and an outlet configured to be in fluid communication with a subsea flow system. A flow control mechanism is disposed in a flow path between the inlet and the outlet and is arranged to adjust a flow rate through the flow path. The flow control mechanism is configured to automatically adjust the flow rate of injection fluid through the flow path according to a pressure differential between fluid pressure at the inlet and fluid pressure at the outlet. Adjustment may be self-regulating, or may be controlled by a hydraulic control circuit.

Aspects of the invention facilitate injection and sampling through a combined unit which provides an injection access point and a sampling access point. However, the invention also has application to a range of intervention operations, including fluid introduction for well scale squeeze operations, well kill, hydrate remediation, and/or hydrate/debris blockage removal; fluid removal for well fluid sampling and/or well fluid redirection; and/or the addition of instrumentation for monitoring pressure, temperature, flow rate, fluid composition, erosion and/or corrosion.

The apparatus and systems of embodiments described herein are capable of performing multiple functions including (a) a flow shut-off valve; (b) a back flow prevention or check valve; (c) an automatic flow-rate control valve; and/or (d) an injection hose anti-collapse valve in a single unit which is convenient, safe, and relatively low cost to deploy. The principles of the invention may obviate the need for collapse resistant hoses, which changes the cost profile of fluid intervention operations.

The invention is particularly suitable for use with hubs and/or hub assemblies which facilitate convenient intervention operations by facilitating access to the flow system in a wide range of locations. These include locations at or on the tree, including on a tree or mandrel cap, adjacent the choke body, or immediately adjacent the tree between a flowline connector or a jumper. Alternatively the apparatus of the invention may be used in locations disposed further away from the tree. These include (but are not limited to) downstream of a jumper flowline or a section of a jumper flowline; a subsea collection manifold system; a subsea Pipe Line End Manifold (PLEM); a subsea Pipe Line End Termination (PLET); and/or a subsea Flow Line End Termination (FLET).

Various modifications may be made within the scope of the invention as herein intended, and embodiments of the invention may include combinations of features other than those expressly described herein.

The invention claimed is:

1. A hose termination unit for a fluid injection hose in a subsea hydrocarbon production system, the hose termination unit comprising:

a first coupling configured for connection to the subsea hydrocarbon production system;

a second coupling configured for connection to the fluid injection hose; and a flow control valve disposed between the first and second couplings; wherein the flow control valve comprises:

an inlet configured to be in fluid communication with the fluid injection hose via the second coupling;

an outlet configured to be in fluid communication with a subsea flow system of the subsea hydrocarbon production system via the first coupling; and a flow control mechanism disposed in a flow path between the inlet and the outlet and arranged to regulate a flow rate through the flow path;

wherein the flow control mechanism comprises a spool assembly movable in a valve bore to automatically regulate the flow rate of injection fluid through the flow path in response to a pressure differential between fluid pressure at the inlet and fluid pressure at the outlet.

2. The hose termination unit according to claim 1, wherein the flow control mechanism is configured to close to prevent fluid flow in the flow path in a direction from the outlet to the inlet in response to a pressure differential between fluid pressure the fluid injection hose and fluid pressure in the subsea flow system.

3. The hose termination unit according to claim 1, wherein the flow control mechanism is configured to close in response to a low pressure condition at the fluid injection hose.

4. The hose termination unit according to claim 1, wherein the valve is a pressure balanced valve.

5. The hose termination unit according to claim 1, wherein the flow control mechanism is operable by a hydraulic control circuit.

6. The hose termination unit according to claim 1, wherein the flow control mechanism is configured to be actuated to close to prevent fluid flow through the flow path by a control signal or by a failsafe close actuation mechanism.

7. The hose termination unit according to claim 1, wherein the spool assembly comprises a choke sleeve assembly.

8. The hose termination unit according to claim 1, wherein a position of the spool assembly is operable to be controlled by a torque bucket stem.

9. The hose termination unit according to claim 8, wherein the position of the spool assembly is operable to be controlled by the torque bucket stem to define the size of a valve orifice.

10. The hose termination unit according to claim 1, wherein the spool assembly comprises a sleeve with a plurality of radial ports.

11. The hose termination unit according to claim 10, wherein the sleeve comprises a choke sleeve.

12. The hose termination unit according to claim 1, further comprising a check poppet.

13. The hose termination unit according to claim 10, wherein the sleeve comprises a choke sleeve, and further comprises a spool piece located internally to the choke sleeve.

14. The hose termination unit according to claim 13, wherein the position of the spool piece with respect to the choke sleeve is controlled by a pressure drop across a valve orifice.

15. The hose termination unit according to claim 13, wherein the spool piece is movable in the valve to regulate a flow rate through the valve by opening and closing radial ports.

16. The hose termination unit according to claim 1, wherein the valve comprises an ambient pressure vent, which functions to close the valve if the pressure at the inlet drops to a pressure below ambient pressure.

17. A subsea fluid injection system for a subsea hydrocarbon production system, the subsea fluid injection system comprising:

the fluid injection hose;

the subsea flow system; and the hose termination unit according to claim 1 disposed between the fluid injection hose and the subsea flow system.

18. A method of performing a subsea fluid injection operation in a subsea hydrocarbon production system, the method comprising:

providing the subsea fluid injection system according to claim 17;

injecting an injection fluid from the fluid injection hose to the subsea flow system through the flow path of the flow control valve;

regulating the flow rate of injection fluid through the flow path automatically using the flow control mechanism responsive to a pressure differential between fluid pressure in the fluid injection hose and fluid pressure in the subsea flow system.

19. The subsea fluid injection system according to claim 17, wherein the valve of the hose termination is a pressure balanced valve.

20. The subsea fluid injection system according to claim 17, wherein the flow control of the valve mechanism is operable by a hydraulic control circuit.

* * * * *